US005642668A

United States Patent [19]

Schaede et al.

[11] Patent Number: 5,642,668

[45] Date of Patent: Jul. 1, 1997

[54] CYLINDER ELEMENT ADJUSTING DEVICE

[75] Inventors: Johannes Georg Schaede, Wurzburg; Peter Eugen Wagner, Grüsfeld, both of Germany

[73] Assignee: Koenig & Bauer-Albert Aktiengesellschaft, Wurzbugr, Germany

[21] Appl. No.: 638,542

[22] Filed: Apr. 26, 1996

[30] Foreign Application Priority Data

Apr. 28, 1995 [DE] Germany ..... 195 15 632.3

[51] Int. Cl.[6] ..... B41F 21/00

[52] U.S. Cl. ..... 101/415.1; 101/DIG. 36

[58] Field of Search ..... 101/382.1, 383, 101/415.1, 477, DIG. 36

[56] References Cited

U.S. PATENT DOCUMENTS

| | | | |
|---|---|---|---|
| 5,315,931 | 5/1994 | Doersam | 101/415.1 |
| 5,398,609 | 3/1995 | Stiel | 101/415.1 |
| 5,402,722 | 4/1995 | Schneider et al. | 101/415.1 |
| 5,461,981 | 10/1995 | Schneider et al. | 101/415.1 |
| 5,503,073 | 4/1996 | Bär | 101/415.1 |

FOREIGN PATENT DOCUMENTS

| | | |
|---|---|---|
| 1013664 | 1/1958 | Germany . |
| 3504435 | 8/1986 | Germany . |
| 3827944 | 3/1989 | Germany . |

*Primary Examiner*—Christopher A. Bennett

*Attorney, Agent, or Firm*—Jones, Tullar & Cooper, P.C.

[57] ABSTRACT

A cylinder element adjusting device utilizes one or more translatable threaded bolts to adjust the positions of cylinder carried elements such as front lay marks. Each threaded bolt carries a gear wheel which is rotatable in incremental steps by a drive ratchet that is driven from a pulse-controlled work cylinder. No electrical energy is transmitted to the cylinder.

7 Claims, 3 Drawing Sheets

CYLINDER ELEMENT ADJUSTING DEVICE

FIELD OF THE INVENTION

The present invention is directed generally to a cylinder element adjusting device. More particularly, the present invention is directed to a device for adjusting elements on a cylinder of a rotary printing press. Most specifically, the present invention is directed to a device for adjusting elements on a cylinder of a rotary printing press by using threaded bolts that can be turned by gear wheels. The threaded bolts act on the elements to be adjusted and are displaceably supported in the cylinder. Each threaded bolt carries a gear wheel. As the gear wheel is rotated, the threaded bolt will translate in the cylinder and will adjust the element with which it is in contact. Rotation of the gear wheel for each threaded bolt is accomplished by drive ratchets moved by pneumatic cylinders.

DESCRIPTION OF THE PRIOR ART

In the field of rotary printing, it is generally well known to provide various cylinders, which form parts of the rotary printing press, with elements that are situated generally at the periphery of the cylinder and whose position on the cylinder must periodically be shifted or adjusted. One example of such elements are paper stops or front lays which are used to stop the forward progress of a sheet or a web of paper and to locate the front edge of this sheet or web on the cylinder so that it can be taken over by suitable sheet grippers. It is periodically necessary to adjust the position of one or more of these sheet stops or front register lays in accordance with the configuration of the sheet leading edge.

One prior art device for use in accomplishing the adjustment of paper stops on a cylinder in a rotary printing press is shown in German Patent Publication DE 35 04 435 A1. In this device, the adjustable paper stops are fastened on a register rail. At least three adjustment screws are provided for accomplishing the adjustment of the register rail and thus of the paper stops. These three adjustment screws are each rotatable by use of a servo motor. The servo motor for each adjustment screw must be provided with electrical energy to operate it, and must be controlled by appropriate control signals. Since the servo motors are situated within the interior of the rotating cylinder, which is part of the rotary printing press, it is a difficult task to provide the servo motors with both electrical energy as well as with control signals.

It will be seen that a need exists for a device for adjusting elements on a cylinder of a rotary printing press which overcomes the limitations of the prior art devices. The cylinder element adjusting device in accordance with the present invention accomplishes that result and is a significant improvement over the prior art devices.

SUMMARY OF THE INVENTION

It is an object of the present invention to provide a cylinder element adjusting device.

Another object of the present invention is to provide a device for adjusting elements on a cylinder of a rotary printing press.

A further object of the present invention is to provide a device for adjusting elements on a cylinder by using threaded bolts turned by gear wheels.

Still another object of the present invention is to provide a cylinder element adjusting device which facilitates the remote adjustment of those elements.

Yet a further object of the present invention is to provide a device for adjusting elements on a cylinder without it being necessary to transmit electrical energy to the rotating cylinder.

As will be discussed in detail in the description of the preferred embodiment which is presented subsequently, the device for adjusting elements on a cylinder of a rotary printing press utilizes threaded bolts that act on the elements and which are disposed on the cylinder for translational and rotational movement. Each threaded bolt carries a gear wheel at its end opposite to the bolt end which engages the element to be adjusted. The gear wheel is rotatable in either of its two directions of travel by drive ratchets that are situated adjacent the gear wheel. Each drive ratchet is moved by a working cylinder that can be charged with a pressure medium, such as, for example, compressed air. Rotation of the gear wheel and hence translation of the threaded bolt are accomplished during the work stroke of the work cylinder by not during the return stroke of the work cylinder. The pressure medium can be supplied to each work cylinder by a suitable rotatable coupling, and control of the pressure medium can be accomplished in the supply line exterior of the rotating cylinder.

A particular advantage of the cylinder element adjusting device in accordance with the present invention resides in the fact that elaborate rotating transmitting devices, which must be used to transmit electrical power and control signals to the prior art servo motor, are not required in connection with the present invention. Such wear prone items as slip ring transmitters are not needed. Additionally, since the rotation of the gear wheel for each threaded bolt can be accomplished in small discrete adjusting steps, it is not necessary to provide responding sensors to monitor and report the position of the elements being adjusted. The indication of the position of the elements being adjusted, such as, for example, the front stops on the cylinder can take place simply by counting the number of element setting pulses supported to the working cylinders. This counting can easily be accomplished outside of the rotary cylinder.

Another advantage of the present invention is its complete absence of electrical components. This device is accordingly very well suited for use in areas in which explosion proof equipment would otherwise be required. Such areas are, for examples, in sheet-fed rotogravure printing presses. This elimination of explosion protected components reduces the cost of the equipment and also contributes to its safety of operation.

The cylinder element adjusting device in accordance with the present invention overcomes the limitations of the prior art devices. It is a substantial advance in the art.

BRIEF DESCRIPTION OF THE DRAWINGS

While the novel features of the cylinder element adjusting device in accordance with the present invention are set forth with particularity in the appended claims, a full and complete understanding of the invention may be had by referring to the detailed description of the preferred embodiment, as presented subsequently, and as illustrated in the accompanying drawings, in which:

DETAILED DESCRIPTION OF THE PREFERRED EMBODIMENT

Figure 1:
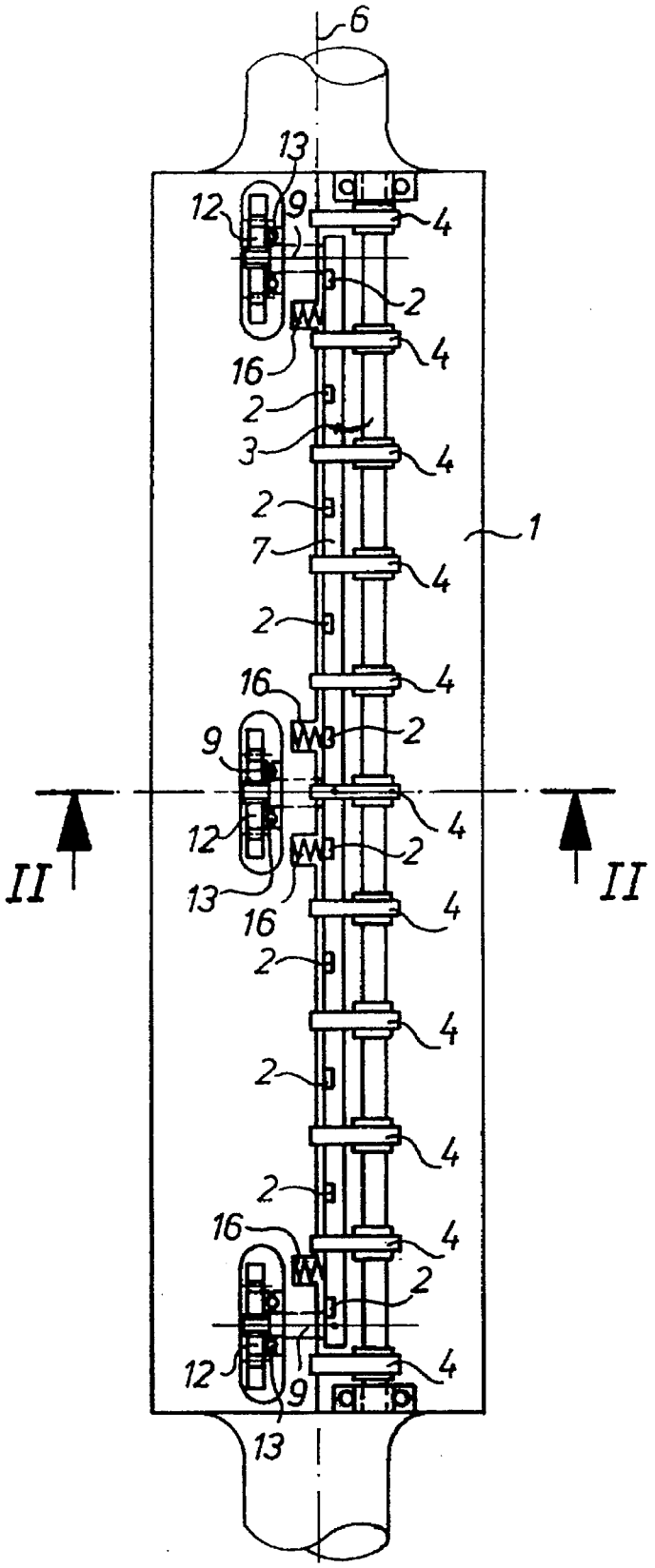
FIG. 1 is a schematic top plan view of a cylinder of a rotary printing press and showing the cylinder element adjusting device in accordance with the present invention.

Referring initially to FIG. 1, there may be seen a first cylinder, generally at 1, which is part of a rotary printing press that is not specifically depicted in the drawings. This cylinder 1 is supported between spaced side frames of the printing press for rotation about its axis of rotation 6. The cylinder 1 in accordance with the present invention is utilized in a feed guide of a sheet-fed rotary printing press, but the cylinder element adjusting device in accordance with the present invention is not limited to use with this type of cylinder or with any particular type of cylinder. Since the sheet-fed rotary printing press, in which the cylinder 1 operates, forms no part of the present invention, it will not be discussed in detail.

Figure 2:
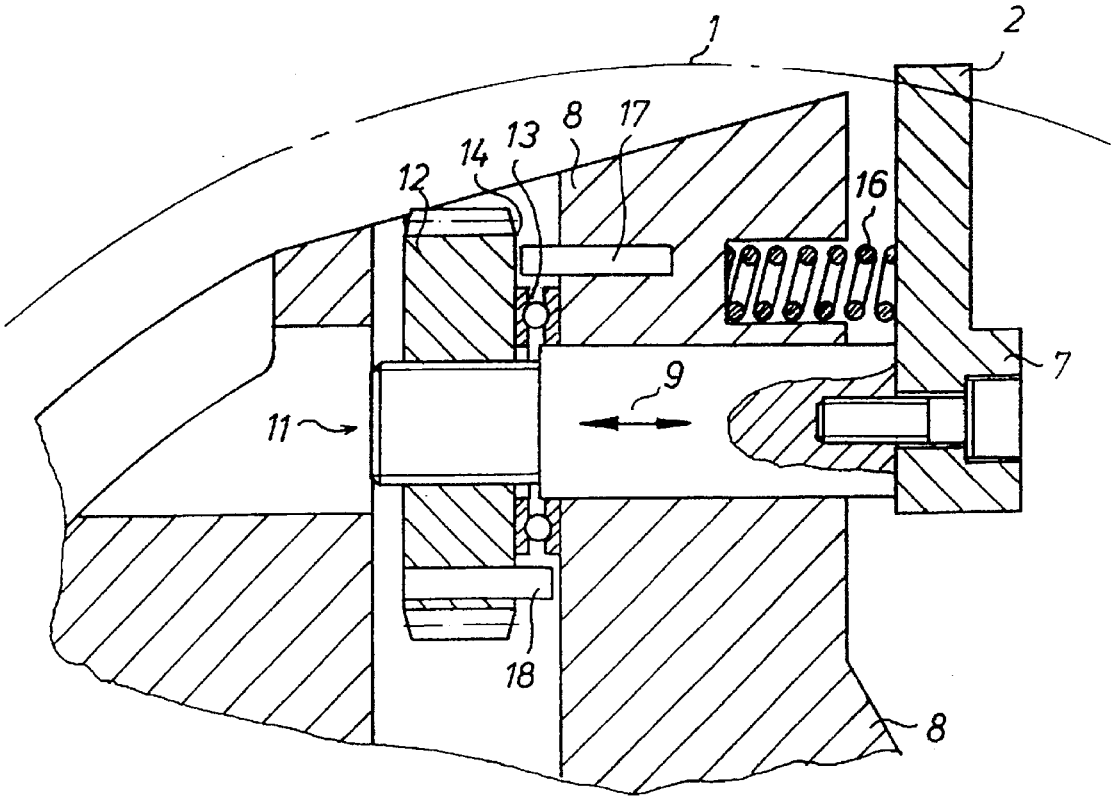
FIG. 2 is a cross-sectional view through the cylinder and taken along line II—II of FIG. 1.

Again referring to FIG. 1, and taken in conjunction with FIG. 2, the cylinder 1, which takes on sheets, not shown, is provided with front lay marks 2 and with sheet leading edge grippers 4 which are seated on a spindle 3. The placement and alignment of the sheets, which are processed in the sheet-fed rotary printing press, takes place on this cylinder 1. At least two of these front lay marks 2 are disposed, in their zero position, generally parallel with the axis of rotation 6 of the cylinder 1 and on its circumference, as seen in FIG. 2. In the present invention, a plurality of front lay marks 2 are fastened on a common register rail 7. This register rail 7 is seated in cylinder 1 so that it is displaceable in respect to the cylinder 1 in the tangential direction. To perform this adjustment movement, displaceably seated threaded bolts 9 are translationally supported in a body portion 8 of the cylinder 1 at both ends as well as at the center of the register rail 7. As may be seen most clearly in FIG. 2, each threaded bolt 9 is translatable or displaceable generally in the tangential direction of the cylinder 1 as indicated by the two headed arrow shown on the threaded bolt 9 in FIG. 2. A first end of each bolt 9 is secured to the register rail 7 by a suitable fastener.

Referring again primarily to FIG. 2, a gear wheel 12, which is provided with a centered interior thread, is screwed to a threaded second end 11 of the threaded bolt 9, with this second end of bolt 9 facing away from the register rail 7. The gear wheel 12 is carried on bolt 9 in a rotatable, but otherwise fixed-in-place manner. This gear wheel 12 is supported on a first end face 14 by an axial bearing 13 interposed between end face 14 and the body 8 of the cylinder 1. This axial bearing 13 forms a counter-support for the force generated by pressure springs 16 that are acting on the register rail 7 in the tangential direction of the cylinder 1. These pressure springs 16 are disposed between the register rail 7 and the body 8 of the cylinder 1. A first pin 17 is fastened in the body 8 of the cylinder 1, and a second pin 18 is fastened in the gear wheel 12. These pins 17 and 18 are disposed generally at 180° with respect to each other and together act as a stop for the gear wheel 12 in the circumferential direction when they engage each other. Thus where the gear wheel 12 is rotated through 180° from the position depicted in FIGS. 2 and 3, the pins 17 and 18 will move into contact with each other and will prevent further rotation of the gear wheel 12 and thus will limit the translation or displacement of the threaded bolt 9.

Figure 3:
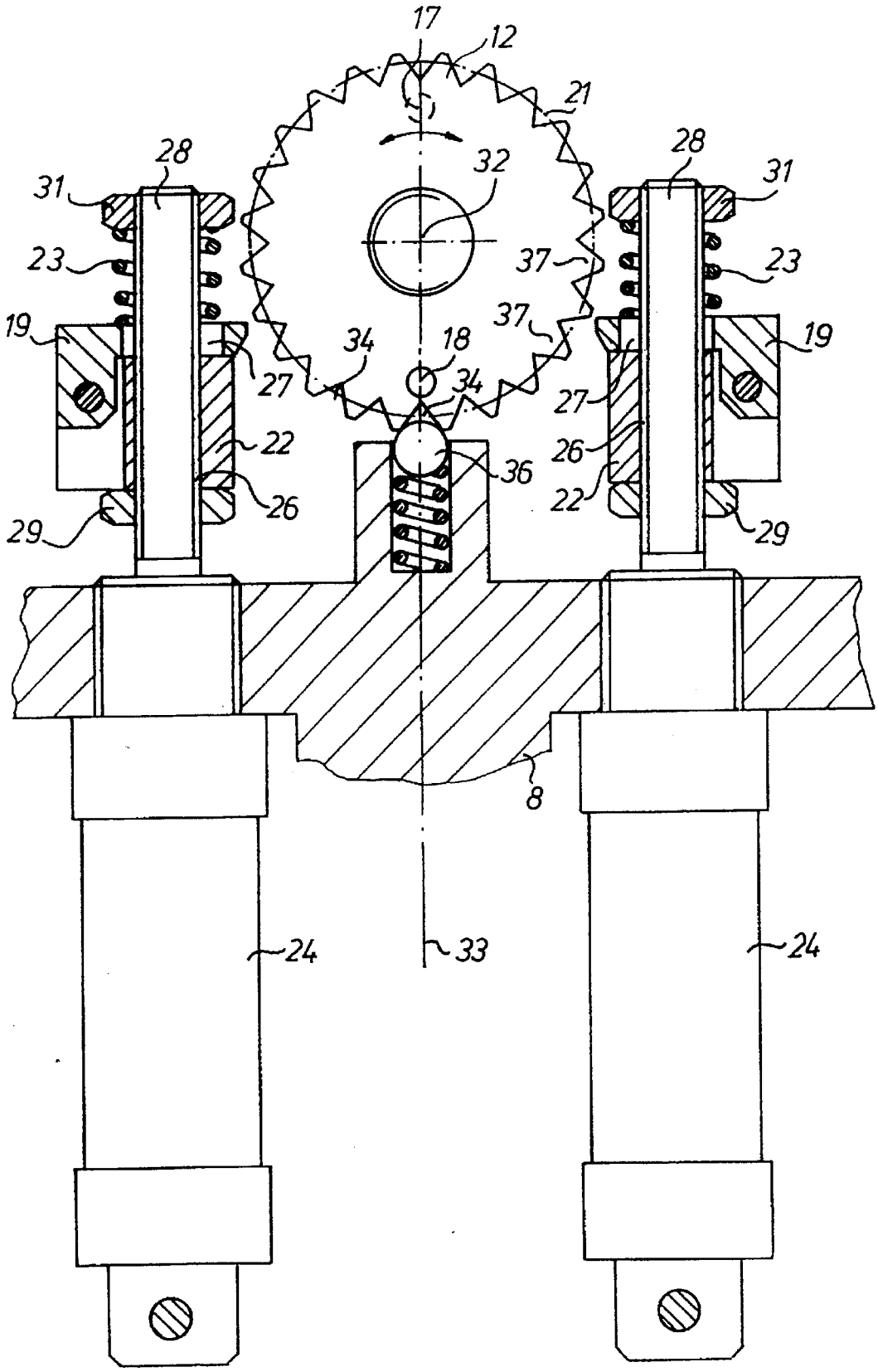
FIG. 3 is a schematic front elevation view of the adjusting device and showing the drive ratchet and working cylinders.

Turning now primarily to FIG. 3, two drive ratchets 19, which cooperate with the gear wheel 12, are tangentially seated and are linearly movable with respect to the pitch circle 21 of the gear wheel 12. These drive ratchets 19 are seated, pivotable in respect to the circumferential direction of the gear wheel 12, on a base support 22 and are pushed by means of pressure springs 23 into a base position against a base support 22 for each drive ratchet. It will thus be seen that as each drive ratchet 19 is moved radially upwardly, or extended as seen in FIG. 3, its drive pawl will engage a tooth 37 of the gear wheel 12. When the drive ratchet 19 is moved radially inwardly or lowered, its drive pawl will slide over the next tooth 37 on the gear wheel 12. This sliding action of the drive ratchet pawl is allowed by the pivotal movement of the drive ratchet about its pivot shaft and is opposed by the force of pressure spring 23 which will tend to pull the drive ratchet 19 down against its base support 22.

The base supports 22 with the drive ratchets 19 are moved in extension and in retraction by work cylinders which may be, for example, pneumatic cylinders 24. These cylinders 24 can be charged with a pressure medium from a suitable rotatable coupling, not shown, and are fastened in the body 8 of the cylinder 1. The base supports 22 are each provided with a bore 26 and the drive ratchets 19 are provided with an elongated hole 27 through which respectively, a piston rod 28 of the pneumatic cylinder 24 extends. A first, inner threaded nut 29 is screwed on the piston rod 28 to support the base support 22, and a second, outer threaded nut 31 is disposed on the outer, free end of the piston rod 28 for supporting the pressure spring 23. In the preferred embodiment, the pneumatic cylinders 24 are disposed parallel to each other and are symmetrical with respect to an axis of symmetry extending through a rotating shaft 32 that supports the gear wheel 12. A resiliently seated ball catch 36 is fastened in the body 8 of the cylinder 1 between the pneumatic cylinders 24, and which acts on a tooth space 34 of the gear wheel 12. This ball catch 36 tends to hold the gear wheel in place. It will be understood that rotational forces applied to the gear wheel 12 by the work cylinders 24, through the drive ratchets 19 are sufficient to overcome the force applied by the ball catch 36 so that the gear wheel can be rotated. It will also be understood that the force applied to the pivotal drive ratchet 19 by the pressure spring 23, and which opposes the pivotal movement of the drive ratchet 19 when the work cylinder piston rod 28 is retracted, is less than the spring force exerted by the spring bearing the ball catch 36. If this were not the case, the gear wheel 12 would rotate against the force of the ball catch 26 where the piston rod 28 was retracted. This would not allow the gear wheel 12 to be turned in a stepwise manner in either direction during repeated cycles of either one of the work cylinders 24.

In the operation of the cylinder element adjusting device in accordance with the present invention, it may be necessary to shift one or more of the front lay marks 2 tangentially or circumferentially on the periphery of the cylinder 1. This is due to the existence of oblique, convexly or concavely cut front edges of the sheets to be processed by the cylinder 1. Thus it is necessary to adjust or to adapt the locations of the axially spaced front lay marks 2 with the shape of the front edge of the sheets that will be fed to the cylinder 1. To accomplish this front lay mark adjustment, the register rail 7 will be obliquely displaced or bent by actuation of at least one of the cylinder element adjusting devices in accordance with the present invention. A selected one of the several working cylinders 24 is activated to accomplish this tangential displacement of a portion of the register rail 7. As the piston rod 28 of the selected working cylinder 24 is elevated, as shown in FIG. 3, it displaces the drive ratchet 19 which is supported on the base support 22. This drive ratchet 19 moves upwardly in a tangential direction with respect to the pitch circle 21 of the gear wheel 22. In the process, the drive pawl of the drive ratchet 19 will engage one of the teeth 37 on the gear wheel 12 and will cause the gear wheel 12 to rotate through a corresponding angle of rotation. In this case, the driving force acting on the gear wheel 12 from the drive ratchet 19 is greater than the effective holding force exerted on the gear wheel 12 by the ball catch 36. As the gear wheel 12 rotates, the ball catch 36 is depressed by tooth 37 passing over it and then springs back into the tooth space 34 after the tooth 37 passes by. The pneumatic cylinder 24 is then evacuated and the piston rod 28 is caused to retract. As discussed above, the drive ratchet 19 pivots on its pivot shaft against the force of the drive ratchet pressure spring 23 which spring force is less than that exerted by the ball catch 36. This allows the drive ratchet drive pawl to engage the flank of the next gear wheel tooth 37, to pivot about its pivot shaft, and to pass down past the tooth 37 as the piston rod 28 retracts. With the piston rod 28 again in its retracted position, as depicted in FIG. 3, it can again be extended by repressurization of the work cylinder 24 to again cause the gear wheel 12 to rotate through another corresponding angle of rotation. Each such rotation of the gear wheel will cause the threaded bolt 9 to translate or to be displaced in the direction toward or away from the register rail and thus to effect a circumferential shifting of the front lay mark or marks 2 secured to the register rail 7 in the vicinity of the translating bolt 9.

In the configuration depicted in FIG. 3, the gear wheel 12 is rotated in a counterclockwise direction by actuation of the right drive ratchet 19. A clockwise rotation of the gear wheel 12 is accomplished by an extension of the left drive ratchet 19. As discussed above, the rotation of the gear wheel 12 is converted into a translational displacement of the threaded bolt 9 and thus a movement of the register rail 7 and of the front lay marks 2 attached to it.

To adjust the device, one of the pneumatic cylinders 24 performs more strokes than the maximum displacement path permits. This will bring the gear wheel from 18 into contact with the cylinder body mounted pin 17. This places the gear wheel 12 in a defined position. Based on this defined position, a control, which is not specifically shown, of the pneumatic cylinders 24 can approach each position of the threaded bolts 9 of the register rail 7 in discrete steps.

If the orientation of thee threaded bolts 9 and their associated gear wheels 12 and working cylinders 24 is rotated through generally 90° from the orientation shown in FIGS. 1–3, so that the threaded bolts 9 extend generally radially and bear against the bottom surface of the register rail 7, it will then be possible to accomplish a height adjustment of the front lay marks 2. It will be understood that such a re-orientation of the threaded bolts 9 and their associated actuating devices would also require a repositioning of the pressure springs 16 so that they would effect a radially inwardly directed force on the register rail 7.

The cylinder element adjusting device in accordance with the present invention could also be used to adjust cylinder elements other than front lay marks. Other cylinder elements, such as plate clamping devices, register pins and the like on other cylinders, such as plate cylinders of a rotary printing press could also be positionally adjusted. If desired, the pivotable drive ratchets 19 of the present invention could also be embodied as, for example, leaf springs carried on the base supports 22. The adjustment movement of the cylinder element is performed in discrete steps by means of pulse-controlled work cylinders.

While a preferred embodiment of a cylinder element adjusting device in accordance with the present invention has been set forth fully and completely hereinabove, it will be apparent to one of skill in the art that a number of changes in, for example, the overall size of the cylinder, the type of rotary printing press, the drive for the press and cylinder and the like could be made without departing from the true spirit and scope of the present invention which is accordingly to be limited only by the following claims.

What is claimed is:

1. A cylinder element adjusting device for adjusting elements on a cylinder of a rotary printing press comprising:

at least a first threaded bolt disposed in said cylinder for displacement, said threaded bolt being in engagement with said element to be adjusted;

a gear wheel carried by said threaded bolt and being rotatable to effect said displacement of said threaded bolt;

at least one drive ratchet engageable with said gear wheel and operable to rotate said gear wheel; and a work cylinder which can be charged by a pressure medium, said work cylinder being operable to move said drive ratchet.

2. The device in accordance with claim 1 wherein said gear wheel has a pitch circle and further wherein said drive ratchet is movable generally tangentially with respect to said pitch circle.

3. The device in accordance with claim 1 further including a base support for said drive ratchet, said drive ratchet being pivotably supported on said base support and being rigidly engageable with said gear wheel in a first direction of movement of said work cylinder and being pivotable with respect to said gear wheel in a second direction of movement of said work cylinder.

4. The device of claim 3 wherein said base support is movable by said work cylinder.

5. The device of claim 1 wherein said elements to be adjusted are front lay marks of a sheet-fed rotary printing press.

6. The device of claim 5 wherein said front lay marks are adjustable in a tangential direction on said cylinder.

7. A device for adjusting an element on a rotating cylinder of a rotary printing press comprising:

at least one threaded bolt disposed in said cylinder for displacement, said threaded bolt being in engagement with said element to be adjusted;

a gear wheel carried by said threaded bolt and rotatable to effect said displacement of said bolt; and at least one pulse-controlled working cylinder having a work stroke and a return stroke, said working cylinder effecting rotation of said gear wheel during said work stroke and not effecting rotation of said gear wheel during said return stroke.

* * * * *